US008738330B1

(12) United States Patent
DiMartino et al.

(10) Patent No.: US 8,738,330 B1
(45) Date of Patent: May 27, 2014

(54) SCALABLE, INERT MUNITION DATA RECORDER AND METHOD TO CHARACTERIZE PERFORMANCE OF A WEAPON SYSTEM

(75) Inventors: Daniel DiMartino, North Haledon, NJ (US); Jeffrey Darbig, Flanders, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 363 days.

(21) Appl. No.: 13/213,521

(22) Filed: Aug. 19, 2011

(51) Int. Cl.
*F42B 12/58* (2006.01)

(52) U.S. Cl.
USPC ..... 702/187; 102/438; 102/519; 102/202; 102/472; 102/376; 102/377; 102/380; 102/432; 102/518; 102/293; 102/443; 244/3.2; 244/3.23; 244/3.28

(58) Field of Classification Search
USPC ..... 702/187; 348/144; 102/438, 519, 431, 102/202, 440, 472, 376, 377, 380, 432, 518, 102/293, 443; 244/3.2, 3.23, 3.28
See application file for complete search history.

(56) References Cited

U.S. PATENT DOCUMENTS

| | | | | |
|---|---|---|---|---|
| 4,538,991 | A * | 9/1985 | Simpson et al. | 434/12 |
| 4,930,421 | A * | 6/1990 | Macdonald | 102/377 |
| 5,361,505 | A * | 11/1994 | Faughn | 33/506 |
| 5,432,546 | A * | 7/1995 | Cargill | 348/144 |
| 6,255,658 | B1 * | 7/2001 | Ozil | 250/394 |
| 6,349,652 | B1 * | 2/2002 | Hepner et al. | 102/519 |
| 6,542,076 | B1 * | 4/2003 | Joao | 340/539.14 |
| 6,542,077 | B2 * | 4/2003 | Joao | 340/426.16 |
| 7,397,363 | B2 * | 7/2008 | Joao | 340/539.11 |
| 7,464,649 | B2 * | 12/2008 | Bishop et al. | 102/438 |
| 7,509,766 | B2 * | 3/2009 | Vasquez | 42/1.01 |
| 7,707,941 | B2 * | 5/2010 | Bishop et al. | 102/438 |
| 8,424,233 | B2 * | 4/2013 | Cronin et al. | 42/84 |
| 2004/0200109 | A1 * | 10/2004 | Vasquez | 42/1.01 |
| 2005/0153262 | A1 * | 7/2005 | Kendir | 434/21 |
| 2006/0124020 | A1 * | 6/2006 | Bishop et al. | 102/438 |
| 2007/0068414 | A1 * | 3/2007 | O'Dwyer et al. | 102/374 |
| 2008/0168895 | A1 * | 7/2008 | Duong | 89/1.1 |
| 2009/0006222 | A1 * | 1/2009 | Weidlich et al. | 705/28 |
| 2009/0120317 | A1 * | 5/2009 | Bishop et al. | 102/438 |
| 2012/0160089 | A1 * | 6/2012 | Burzel | 89/41.17 |

* cited by examiner

*Primary Examiner* — Carol S Tsai
(74) *Attorney, Agent, or Firm* — Michael C. Sachs

(57) ABSTRACT

A scalable, inert munition data recorder cartridge. This inert cartridge allows users to record data from within a weapon system feed chute, breach, and extractor port. This cartridge is adaptable to any weapon system, packaging unit, environmental chamber, or other ammunition holding and storage device. Although the cartridge is designed to interface with a weapon and ammunition packaging based on its shape, it still functions as designed regardless of its location and application. This would allow the cartridge to be placed anywhere an actual live cartridge of ammunition could be placed.

13 Claims, 3 Drawing Sheets

SCALABLE, INERT MUNITION DATA RECORDER AND METHOD TO CHARACTERIZE PERFORMANCE OF A WEAPON SYSTEM

GOVERNMENTAL INTEREST

The invention described herein may be manufactured and used by, or for the Government of the United States for governmental purposes without the payment of any royalties thereon.

FIELD OF THE INVENTION

The present invention relates in general to the field of munitions. More specifically, this invention relates to data acquisition acquired by an ammunition cartridge at firing, exit, and during flight. More specifically this invention pertains to data acquisition within ammunition environments including, but not limited to, the weapon system, ammunition packaging, exposure to meteorological and environmental conditions, and the bare case of the ammunition.

BACKGROUND OF THE INVENTION

Useful information about a weapon system and associated ammunition can be gathered with external visual observation of the weapon system in action, and the ammunition whether or not it is packaged.

Internally, weapon barrel sensors record chemical reactions that occur in milliseconds of elapsed time. The feed mechanism and loading chamber of the weapon are not, however, simply observed or characterized by available measurement techniques. The nature of the moving parts prevents a static measurement device from being placed within this part of the weapon.

To date, there does not exist a data recorder that is encased in an inert cartridge case, and which is capable of passing though the weapon chamber, taking measurements, and recording these measurements to an internal storage device, before it is ejected along with the cartridge case in which it is encased.

What is therefore needed is a data recorder that can further be packaged similarly to field ammunition, such that measurements could be taken from within the case during desired procedures and operations. As a standalone device, the data observer could be used to analyze ammunition free from its packaging and outside of a weapon environment. Prior to the advent of the present invention, the need for such an inert data recorder has heretofore remained unsatisfied.

SUMMARY OF THE INVENTION

The present invention satisfies this need, and describes a scalable, inert munition data recorder assembly and method to characterize the performance of a weapon system, ammunition storage, transportation unit, and bare case enclosure.

In a preferred embodiment of the present invention, the inert data recorder assembly includes the following components that are scalable to the weapon system of interest. The internal electronic components include a data sensor, such as one or more 3-axis accelerometer, thermocouple, strain gauge, etc., that is encapsulated in resin and connected to a memory storage device.

A data interface port allows the cartridge to be connected to a computer. An internal power supply powers the electronic components. The housing of the electronic components substantially replicates the outside profile of a cartridge case that is meant to interface with a desired weapon system. For example, an inert data recorder built to work with the M242 autogun will have the outside profile of a 25 mm cartridge.

The data recorder can be manually, remotely, and/or automatically activated prior to, or at the onset of a data recording session within a weapon system or other ammunition environment. During an ammunition event (i.e., weapon system activity, ammunition container vibration, ejection from a weapon, etc.), the data recorder logs data measurements taken by the internal data sensor. The data recorder records data from within a weapon loading magazine, weapon chamber, and during ejection from the weapon. Data logging ends when the data recorder is triggered to, or meets the proper criteria to cease recording. Recorded data will be transferred to a computer where post-processing will occur.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
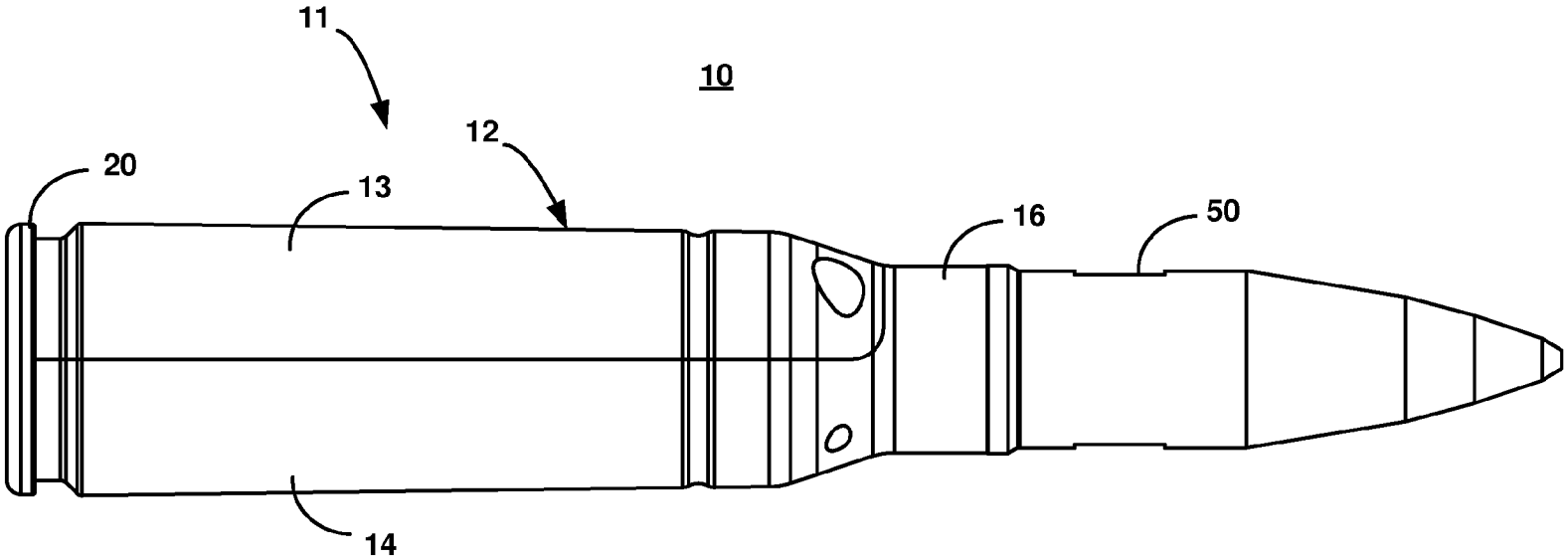
FIG. 1 is a perspective, side elevational view of an exemplary cartridge containing an inert data recorder assembly of the present invention.

FIG. 1 is a perspective, side elevational view of an exemplary cartridge (also alternatively referred to herein as munition or projectile) 10 containing an inert data recorder assembly 100 (FIGS. 2, 3) of the present invention. According to a preferred embodiment, the data recorder assembly 100 is assembled and fits within a weapon system or ammunition packaging or transportation unit. The data recorder assembly 100 records data specific to a sensor during a specific weapon operation. This device can be placed or inserted into any location where the non-inert, live cartridge 10 is, or can in the future, be secured.

The cartridge 10 can be used independently to collect data. Although the cartridge 10 is designed to interface with a weapon and ammunition packaging based on its shape, it still functions as designed regardless of its location and application. This would allow the cartridge 10 to be placed anywhere an actual live cartridge of ammunition could be placed.

Figure 2:
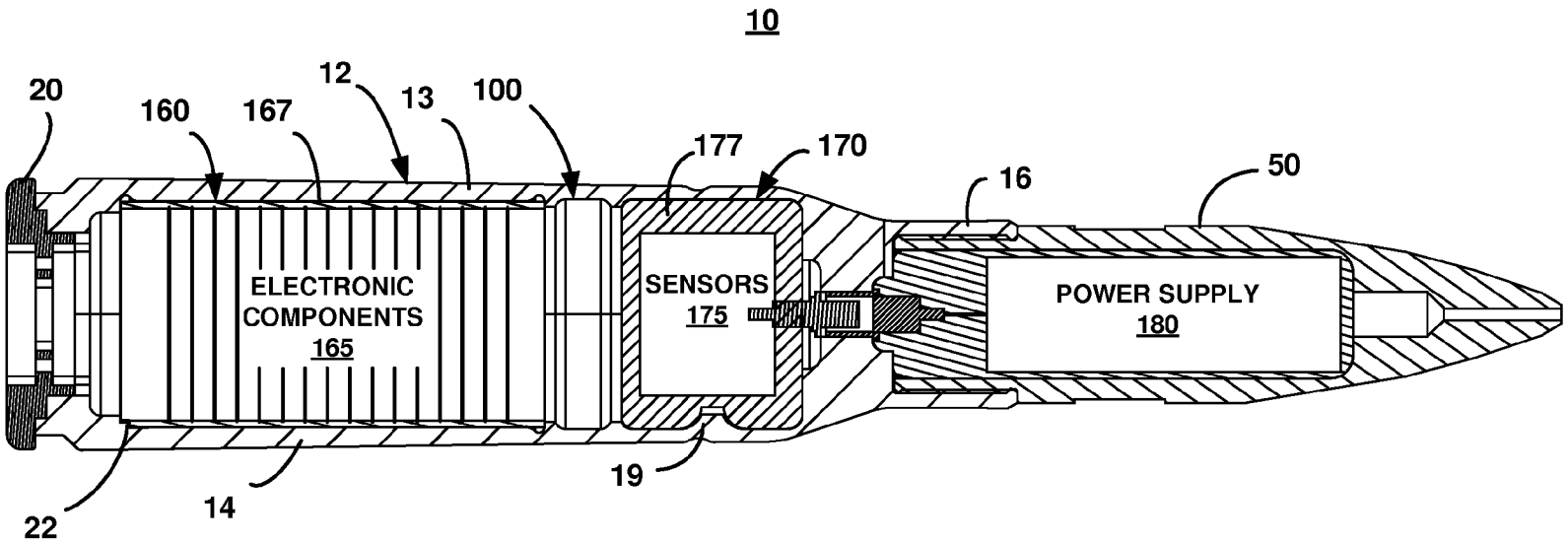
FIG. 2 is a cross-sectional view of the cartridge of FIG. 1, illustrating the components the data recorder assembly.
Figure 3:
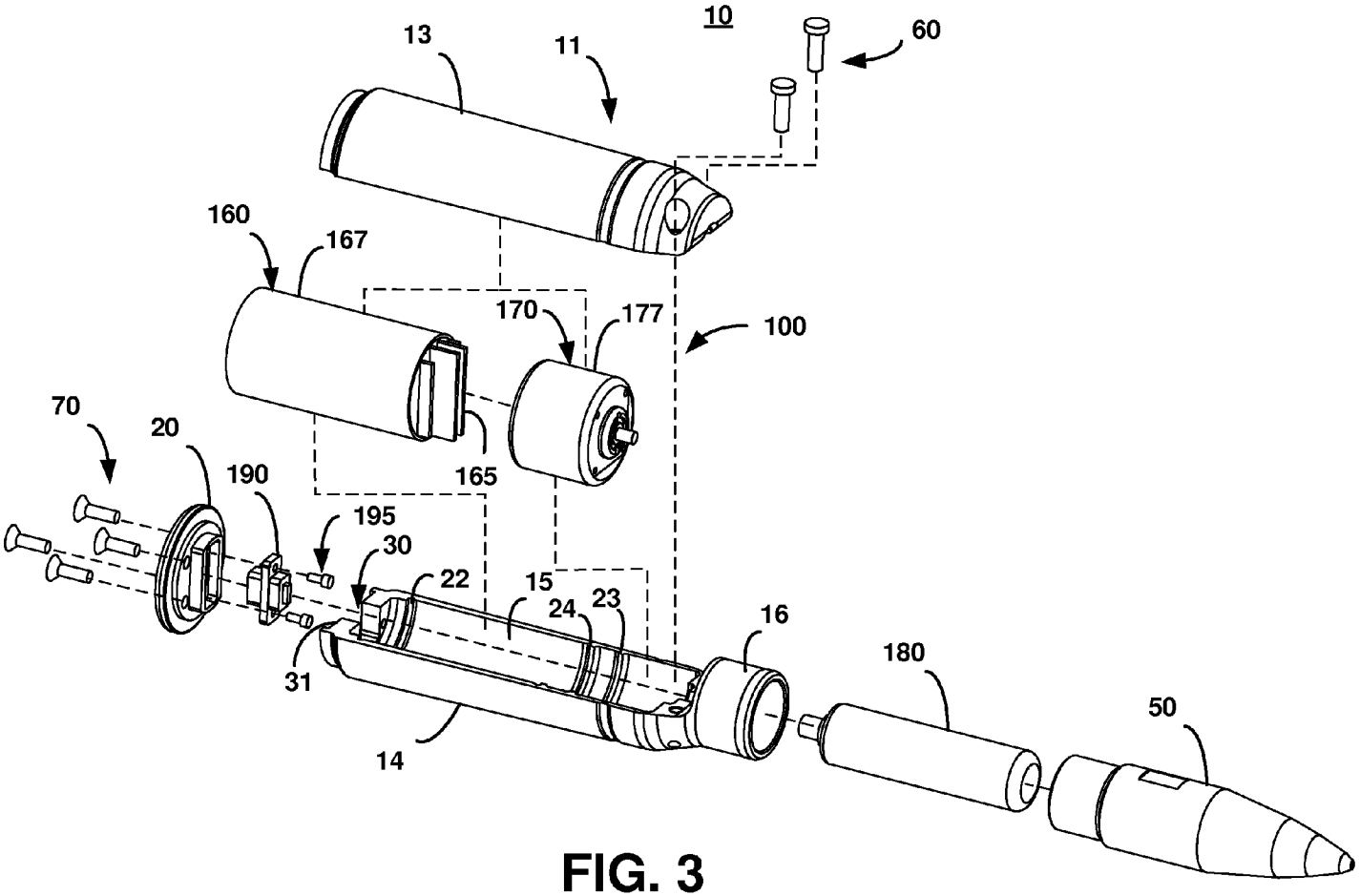
FIG. 3 is an exploded view of the cartridge of FIG. 1, further illustrating the components of the data recorder, to show individual housing components.

With further reference to FIGS. 2 and 3, the cartridge 10 generally includes a casing (or casing assembly) 11 and a data recorder assembly 100. The casing 11 is comprised of a body 12 that includes a cover 13 and a housing 14, a cartridge extractor cap 20, a nose 50, and two screw sets 60, 70 (FIG. 3). The inert data recorder assembly 100 is generally comprised of an onboard data recorder 160, a sensor package 170, a power supply 180, a data interface port 190 (FIG. 3), and a set of screws 195 (FIG. 3).

The data recorder assembly 100 could be integrated into a single unit where the sensors and memory chips are formed in one package. The single unit design would keep the same function and fit into the cartridge casing 11 described herein, and consequently it would increases space within the casing 11 for multiple sensors or additional batteries (or power supplies).

In this particular embodiment, in order to assemble the cartridge 10, the onboard data recorder 160 and the sensor package 170 are independently and separately placed in an axially-oriented cavity 15 of the electronic housing 14. It should however be understood that the onboard data recorder 160 and the sensor package 170 may alternatively be built into the same casing 11.

The exterior shape (or profile) of the data recorder 160 and that of the sensor package 170 substantially correspond to, or match the interior shape of the cavity 15, in order to minimize, if not to prevent the movement of the data recorder 160 and the sensor package 170 within the casing 11.

In this particular example, the data recorder 160 and the sensor package 170 have generally cylindrical shapes that match that of the cavity 15.

The cover 13 is then fitted to the housing 14 in order to further secure and house the data recorder 160 and the sensor package 170, within the chamber that is formed by the cavity 15 of the housing 14, a corresponding (or matching as needed for design purpose) cavity in the cover 13, and an extension 16 of the housing 14.

To further secure the data recorder 160 and the sensor package 170 within the casing 11, the housing 14 is integrally provided with the generally cylindrically shaped extension 16 that houses, at least in part, the sensor package 170. In this particular embodiment, the extension 16 has a generally cylindrically interior shape that substantially matches that of the exterior surface of the sensor package 170.

In addition, and as more clearly shown in FIG. 2, the casing 11 includes a forward locking feature 19 that prevents the rotation of the sensor package 170 within the casing 11. FIG. 3 illustrates one or more lateral protrusions 23 that project inwardly, in order to prevent the sensor package 170 from sliding, along the axial direction, within the casing 11. The locking feature 19 and the protrusion 23 suspend the sensor package 170 with zero degrees of freedom, which is a beneficial feature particularly to a 3-axis accelerometer package where a fixed origin must be maintained for data collection.

Similarly, the casing 11 further includes locking features to suspend the data recorder 160 with zero degrees of freedom. A rearward anti-rotation feature 22 that is formed of one or more lateral protrusions that project inwardly, prevents the data recorder 160 from rotating within the casing 11. This anti-rotation feature 22 may be used as an alignment reference for the data recorder 160, allowing the data recorder assembly 100 to be used in any orientation. A mid-casing inward lateral protrusion 24 prevents sliding of the data recorder 160 in the axial direction along the central axis of the casing 11.

With reference to FIG. 3, the housing 14 includes, at its rearward end, a notch 30 that is formed in a rearward wall 31 of the housing 14, enables access to the data captured by the data recorder assembly 100. A data interface port 190 protrudes, in part through the notch 30 and is electrically connected to the onboard data recorder 160. The data interface port 190 is secured to the rearward wall 31 by means of, for example, the set of screws 195. The cover 13 has a similar feature to that described in connection with the housing 14 to accommodate and secure the data interface port 190. Once assembled, the data interface port 190 further stabilizes the data recorder 160 securely in position within the casing 11.

The sensor package 170 generally includes one or more sensors, such as one or more 3D accelerometers and/or other sensors 175, such as pressure sensors, humidity sensors, temperature, etc. In an exemplary preferred embodiment, the sensors 175 are enclosed in a capsule 177. The capsule 177 can be formed using, for example, a molding process where the sensors 175 are surrounded by cured resin in a mold, such that the outer profile (i.e., shape and dimensions) of the capsule 177 is substantially similar or identical to the interior of the extension 16.

The onboard data recorder 160 is the main hub of all internal wiring of the data recorder assembly 100. The onboard data recorder 160 generally includes one or more electronic components 165 and wiring that accept, record (or store), and possibly process the data captured by the sensors 175 and transmitted to the onboard data recorder 160 by means of the wiring.

With specific reference to FIG. 2, the onboard data recorder 160 further includes a housing 167 that houses the electronic components 165. In another exemplary preferred embodiment, the housing 167 can be formed using, for example, a molding process where the electronic components 165 are surrounded by cured resin in a mold, such that the outside housing 167 shape and dimensions are substantially similar or identical to the interior of the cavity (or chamber) 15.

In this exemplary embodiment, the housing 167 of the onboard data recorder 160 and the capsule 177 of the sensor package 170 are generally cylindrically shaped, and have substantially equal radii. As a result, upon assembly of the onboard data recorder 160 and the sensor package 170 within the casing 11, the exterior surface of the assembly fits within the cavity 15 of the casing 11. In an alternative embodiment, the onboard data recorder 160 and the sensor package 170 may be combined in a single package because they have a similar cylindrical shape.

The cartridge extractor cap 20, which houses, in part, the data interface port 190, is securely affixed to the cover 13 and the housing 14 by means of a set of screws 70 (FIG. 3). The cartridge extractor cap 20 allows external access to the data interface port 190.

The cover 13 and housing 14 of the casing 11 are made of durable material that withstands shocks and that will not be damaged during the ram/extract phase on an autogun or during environmental testing. The extractor cap alignment cap 20 further creates a mechanical lock between the cover 13 and the housing 14.

The nose 50 houses the power supply 180 of the onboard data recorder 160. The nose 50 is affixed to the casing 11 by means of known or available techniques, but allows access to the power supply 180. In this embodiment, the nose 50 is secured to the casing 11, by for example, threading it to the extension 16.

In this preferred embodiment, power is supplied to the data recorder assembly 100 as soon as the nose 50 containing the power supply 180 is secured to the extension 16. Power is terminated once the nose 50 is unscrewed.

Data is retrieved from the onboard data recorder 160, using the data interface port 190, either wirelessly or upon connection to a computer. In this embodiment, all post processing of data is done externally from the data recorder assembly 100. It should however be understood that some or all the processing could be done onboard the cartridge 10 and transmitted externally, either wirelessly or by cable.

The embodiments described herein are included for the purposes of illustration, and are not intended to be the exclusive; rather, they can be modified within the scope of the invention. Other modifications can be made when implementing the invention for a particular application.

What is claimed is:

1. A scalable data recorder for use as part of a cartridge in order to record data from within a chamber in the cartridge during loading, firing, and ejection in a weapon, the scalable data recorder comprising:

a casing;

a data recorder assembly;

the casing includes a body, a cartridge extractor cap, and a nose;

the data recorder assembly includes an onboard data recorder, a sensor package, a power supply;

wherein upon assembly, the casing forms the chamber within the cartridge, and the data recorder assembly is fitted securely within the chamber; and wherein the overall exterior profile of the data recorder assembly substantially corresponds to the interior shape of the chamber, in order to minimize movement of the data recorder assembly within the casing.

2. The scalable data recorder of claim 1, wherein upon assembly, the cover is secured to the housing in order to form part of the chamber that houses the data recorder assembly.

3. The scalable data recorder of claim 2, wherein the housing is integrally provided with an extension that forms part of the chamber and that houses, at least in part, the sensor package.

4. The scalable data recorder of claim 3, wherein the interior surface of the chamber is generally cylindrically shaped; and wherein the profile of the data recorder assembly is generally cylindrically shaped with substantially similar dimensions to the dimensions of the interior surface of the chamber.

5. The scalable data recorder of claim 3, wherein the casing includes at least one alignment and locking feature.

6. The scalable data recorder of claim 2, wherein the power supply is secured within the nose of the cartridge.

7. The scalable data recorder of claim 6, wherein the power supply is further electrically connected to the sensor package and the onboard data recorder to supply electrical energy to the sensor package and the onboard data recorder.

8. The scalable data recorder of claim 7, wherein the sensor package includes at least one sensor for acquiring data.

9. The scalable data recorder of claim 8, wherein said at least one sensor includes at least one accelerometer.

10. The scalable data recorder of claim 8, wherein the acquired data is transmitted from the sensor package to the onboard data recorder.

11. The scalable data recorder of claim 10, wherein the acquired data is stored by the onboard data recorder.

12. The scalable data recorder of claim 11, wherein the casing includes a cartridge extractor cap; and wherein the data recorder assembly further includes a data interface port that is secured to the onboard data recorder, that is in electrical communication with the onboard data recorder, and that protrudes in part from the cartridge extractor cap to enable access to the acquired data.

13. The scalable data recorder of claim 10, wherein the acquired data is further transmitted wirelessly by the onboard data recorder.

* * * * *

UNITED STATES PATENT AND TRADEMARK OFFICE

CERTIFICATE OF CORRECTION

PATENT NO. : 8,738,330 B1
APPLICATION NO. : 13/213521
DATED : May 27, 2014
INVENTOR(S) : Daniel DiMartino et al.

It is certified that error appears in the above-identified patent and that said Letters Patent is hereby corrected as shown below:

On petition requesting issuance of a certificate for correction of inventorship pursuant to 35 U.S.C. 256, it has been found that the above identified patent improperly sets forth the inventorship. Accordingly, it is hereby certified that the correct inventorship of this patent is:

Daniel DiMartino
Jeffrey Darbig
Patrick J. Sweeney Jr.
Patrick Deluca

Signed and Sealed this
Twenty-second Day of September, 2015

Michelle K. Lee

Michelle K. Lee
*Director of the United States Patent and Trademark Office*